US005197252A

United States Patent [19]

Tiscareno

[11] Patent Number: 5,197,252

[45] Date of Patent: Mar. 30, 1993

[54] BATTEN EXTENDER

[76] Inventor: Daniel Tiscareno, 2900 Seven Springs Dr., Placerville, Calif. 95667

[21] Appl. No.: 705,351

[22] Filed: May 24, 1991

[51] Int. Cl.[5] ..... E04D 1/30

[52] U.S. Cl. ..... 52/553; 52/478; 52/551

[58] Field of Search ..... 52/553, 551, 726, 478, 52/22, 696, 747

[56] References Cited

U.S. PATENT DOCUMENTS

| | | | |
|---|---|---|---|
| 3,606,418 | 9/1971 | Buker et al. | 52/726 |
| 4,024,691 | 5/1977 | Hansen et al. | 52/726 X |
| 4,099,357 | 7/1978 | Lester | 52/747 X |
| 4,662,141 | 5/1987 | Miko | 52/553 |

FOREIGN PATENT DOCUMENTS

| | | | |
|---|---|---|---|
| 259829 | 2/1968 | Austria | 52/551 |

*Primary Examiner*—David A. Scherbel

*Assistant Examiner*—Kien Nguyen

*Attorney, Agent, or Firm*—Chernoff, Vilhauer, McClung & Stenzel

[57] ABSTRACT

A batten extender supports and engages roofing tiles that extend over the flashing located at intersections of adjacent roof sections and the intersections of roof sections and walls to keep the tiles aligned and flat without obstructing the flow of water along the flashing or contacting the crimped edge of the flashing and causing it to be flattened. The batten extender includes a plate having approximately the same width as the batten it extends and a length that is greater than the width of the flashing. A support element of the plate has legs that hold it above the flashing without obstructing the flashing and an attachment element of the plate overlies the extremity of the batten. Side flaps extend from the sides of the attachment element and contact the sides of the battens to align the plate with the battens. The attachment element is affixed to the batten by driving nails through it and into the batten.

8 Claims, 3 Drawing Sheets

BATTEN EXTENDER

BACKGROUND AND SUMMARY OF THE INVENTION

Tile roofs utilize elongate battens to position and retain individual tiles in parallel rows. The battens typically are rectangularly cross-sectioned wood elements that extend in parallel, spaced-apart, horizontal rows across the surface of the roof. The tiles have tabs at their upper ends that fit over the battens, and they are secured to the battens by nails.

The majority of the time this procedure works well to orient the tiles in straight, level rows. However, where two roof sections intersect or a roof section intersects a wall, a flashing is installed to prevent water from seeping into the intersection between the roof sections or between the roof section and wall. The flashing extends along the intersection from the peak of the roof to its edge so that any water which reaches the flashing flows along the flashing and off the edge of the roof. With two intersecting roof sections one portion of the flashing overlies the edge of each roof section. When a roof section intersects a wall, one portion of the flashing overlies the edge of the roof and the other portion extends up the wall. In both cases the portion that overlies the roof has a crimped edge in order to form a channel to prevent water from flowing off the edge of the flashing and then seeping back under it where it would reach the intersection.

With many types of roofing material, such as composition roofing, the roofing material does not extend over the entire extent of the flashings and the uncovered portions of the flashings serve as channels for water. However, with tile roofing it is aesthetically desirable that the tiles completely cover the flashings, and this creates a problem. If the battens extend over the flashings they create dams which prevents water from flowing down the flashings and leakage is likely to occur. In addition, the weight of the tiles and battens can flatten the crimps at the edges of the flashings and water will escape from the flashings. If the battens do not extend across the flashings there is nothing to hold the tiles and they will not remain in straight rows. In addition, if not supported by battens the tiles will drop onto the flashings and create dams. Also, placing the upper edges of the tiles over the battens raises them slightly and unsupported tiles will be lower than supported tiles.

The subject invention overcomes the foregoing problems by providing a batten extender having a support element that supports the tiles and engages the tabs in the same manner as the batten, but does not block the flashing or contact the crimp along its edge. This is accomplished with a thin plate having approximately the same width as the batten and a length that is greater than the width of the flashing that will be covered. One end of the plate comprises the support element and the other end comprises an attachment element that overlies the extremity of the batten that is being extended. Legs depending from the support element cause the plate to remain parallel with the roof when the attachment element is placed on the batten. Side flaps, that extend from the attachment element, fit adjacent the sides of the batten and align the plate longitudinally with the batten. The batten extender is attached to the batten by driving nails through the attachment element and into the batten.

In a preferred embodiment the support element extends beyond the legs permitting it to be trimmed to the proper length before installation. Preferably, the entire batten extender is integrally formed from a soft plastic that nails can be driven through to facilitate its installation.

Accordingly, it is a principal object of the subject invention to provide a batten extender that supports and engages roofing tiles extending across a flashing in the same manner as a batten, without obstructing flow along the flashing.

It is a further object of the subject invention to provide such a batten extender that does not contact the crimped edge of the flashing.

It is a still further object of the subject invention to provide such a batten extender that can easily be trimmed upon installation to fit different flashing widths.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
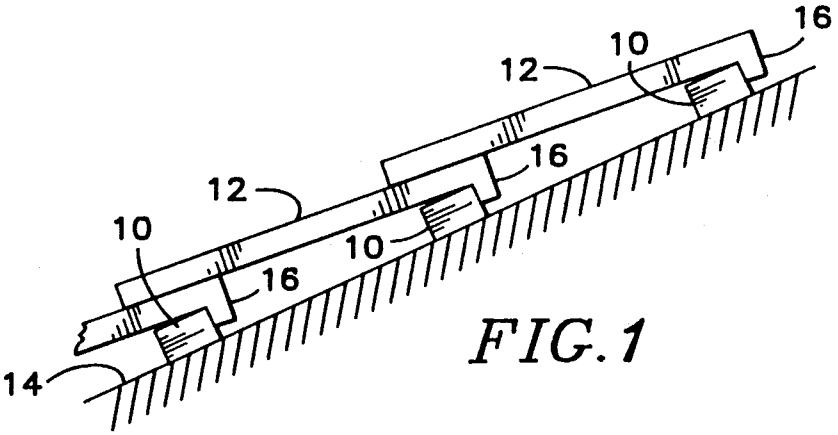
FIG. 1 is a side elevation view of a portion of a tile roof.

Referring to FIG. 1 of the drawings, tile roofs are constructed by attaching elongate wood battens 10 to the top of the roof 14 in parallel, spaced-apart, horizontal rows. The tiles 12 have tabs 16 located at their upper edges which are placed behind the battens when the tiles are installed. Thus, the battens ensure that the tiles remain in straight parallel rows. Nails, not shown, are used to attach the tiles to the battens so that they will not become displaced.

Figure 2:
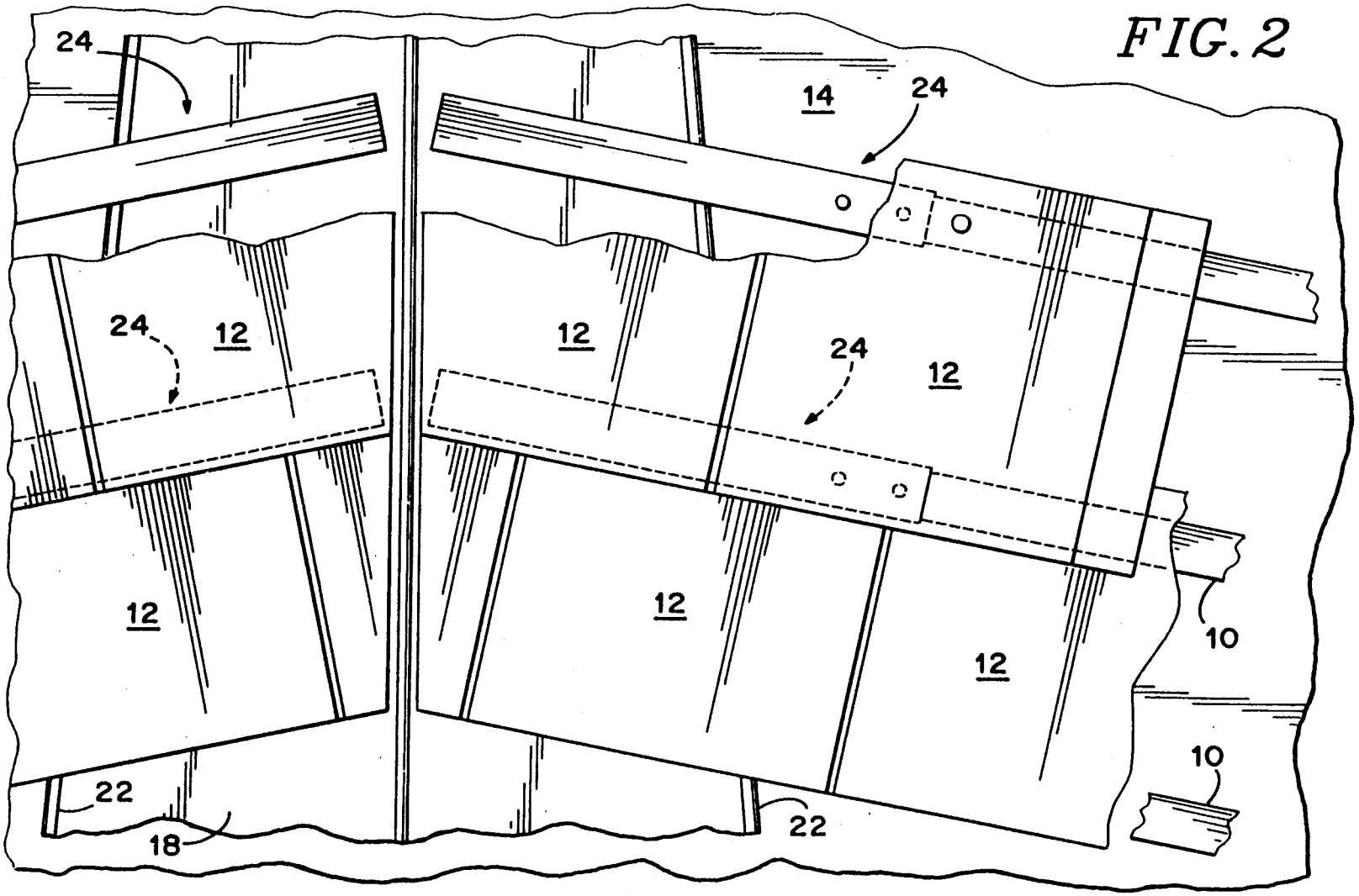
FIG. 2 is a fragmentary plan view of a tile roof, partially broken away to show hidden detail, embodying the batten extender of the subject invention.
Figure 3:
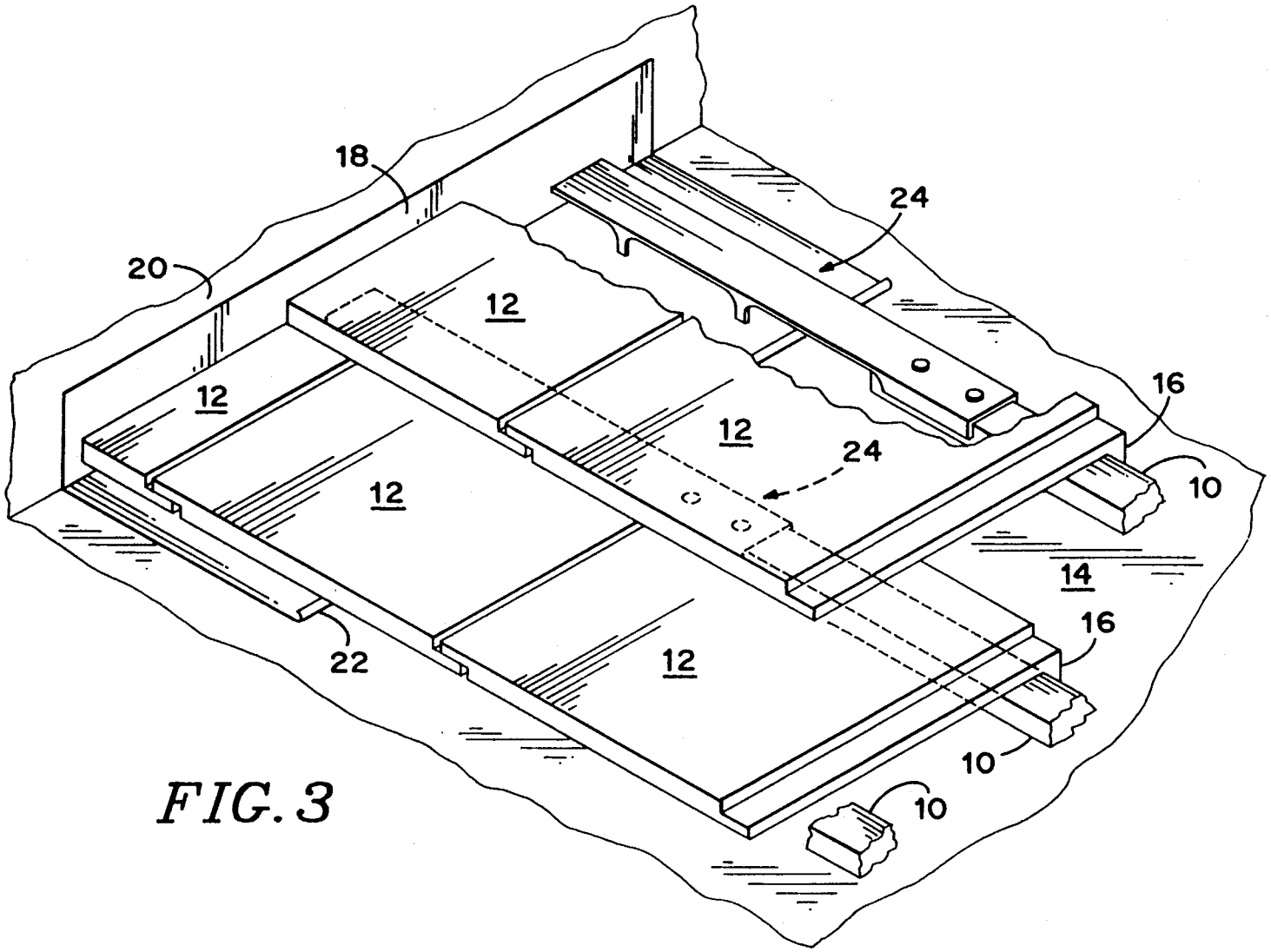
FIG. 3 is a fragmentary perspective view of another section of tile roof embodying the batten extender.

The battens do not extend across the entire roof, but terminate at flashings 18 that overlie the roof where there is an intersection between two roof sections, FIG. 2, or between a roof section and a wall 20, FIG. 3. The flashings typically are sheets of metal which are bent to fit the intersecting roof sections or roof section and wall. The edge or edges of the portion of the flashing which overlies the roof section is crimped 22 in order to prevent water from flowing off of the flashing onto the roof 14. The flashing that covers intersecting roof sections typically flares outward as it extends down the roof to enable it to carry a greater volume of water.

Figure 6:
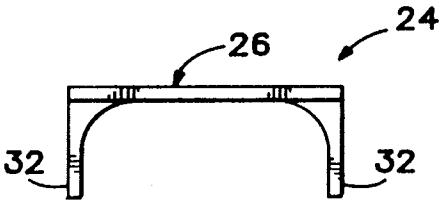
FIG. 6 is an end elevation view of the batten extender.
Figure 4:
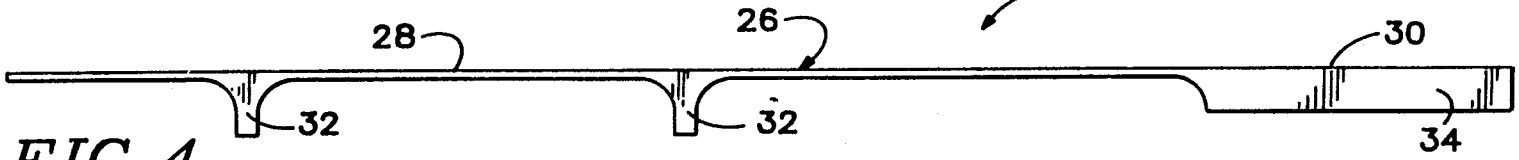
FIG. 4 is a side elevation view of the batten extender.
Figure 5:
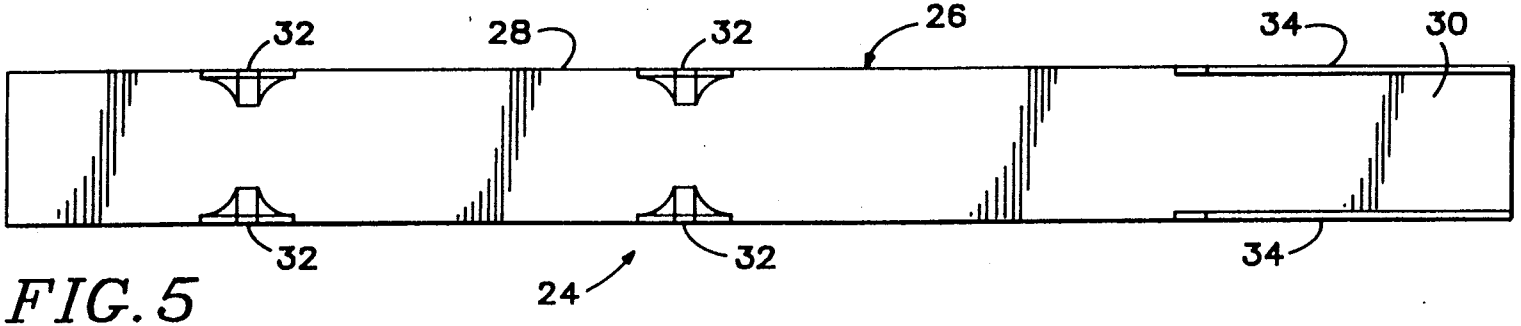
FIG. 5 is a bottom view of the batten extender.

The batten extender 24 of the subject invention extends the batten across the flashing to provide continuous support for the tiles without creating a dam which would obstruct flow of water in the flashing and without flattening the crimped edge 24 which would allow water to flow off the edge of the flashing. Referring now also to FIGS. 4–6, the batten extender 24 includes a thin elongate plate 26 that has substantially the same width as the batten 10 and a length which is somewhat greater than the widest portion of the flashing that it will cover. Battens vary somewhat in width so the plate 26 must be wide enough to cover the widest batten. Thus, the plate will be slightly wider than most battens. The plate includes a support element 28 which extends over the flashing and an attachment element 30 which overlies the extremity of a batten 10. Located at spaced-apart intervals along the support element are a plurality of legs 32 which support it above the roof 14 by a distance that is equal to the height of the batten 10. In the embodiment illustrated, there are two opposed sets of legs and the outermost set is located inwardly from the terminal extremity of the plate. Thus, the extremity of the plate is unsupported and can be trimmed to fit narrower portions of the flashing 18. In the embodiment illustrated, the legs 32 are integral with the plate 26 and are curved to provide extra strength. Preferably, the entire batten extender is made from molded plastic.

The attachment element 30 is considerably shorter than the support element and has side flaps 34 which cover the sides of the batten when the plate 26 is placed on top of the batten. The spacing between the side flaps is equal to the width of the batten, and thus cause the plate 26 to be longitudinally aligned with the batten. The side flaps are shorter than the legs to prevent them from hitting the roof.

The batten extender 24 is installed by first trimming the extremity of the support element 28 of the plate 26 so that it extends across the entire width of the flashing 20 adjacent to the batten 10 it will be installed on. The attachment element 30 of the plate is then placed on the batten and the batten extender is secured to the batten by nails. If the batten extender is made from soft plastic, the nails can simply be driven through it at any desired location. If it is constructed from a harder material preformed nail holes will have to be provided.

Once batten extenders are installed on all the battens, tiles are installed on the batten extenders in the same manner that they are installed on the battens. The batten extenders engage the tabs 16 in the same manner that they engage the battens to keep the tiles aligned, and the tiles remain flat across the entire flashing 20. Since only the legs 32 of the batten extenders contact the flashing, the flashings are open for flow of water through them, and the crimps 22 at the edges of the flashings are untouched and thus will not be flattened.

The batten extenders of the subject invention can also be used to support tile that extends across the flashings placed around chimneys and ventilation ducts.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A batten extender for extending rectangular cross sectioned battens that are attached to the top surface of a roof and have top surfaces that support the tiles in a tile roof across flashings located at the intersection of adjoining roof sections and the intersection of roof sections and abutting walls, said batten extender comprising:

(a) an elongate plate;

(b) said plate having a support element that extends across the flashing and an attachment element that overlies a portion of the top surface of the batten:

(c) means for supporting said support element in a spaced-apart relationship above the flashing approximately coplanar with the top surface of the batten, without obstructing flow of water along the flashing; and (d) means for attaching said attachment portion to the batten.

2. The batten extender of claim 1 including means for aligning said plate with the batten.

3. The batten extender of claim 1 wherein said means for supporting comprises a plurality of spaced-apart legs that project from said support element.

4. The batten extender of claim 3 wherein said support element has a terminal extremity that is unsupported by said legs.

5. The batten extender of claim 3 wherein said means for attaching comprises side flaps which depend from said attachment elements on opposed sides of the batten.

6. The batten extender of claim 5 wherein said plate, said legs and said side flaps comprise an integral piece.

7. The batten extender of claim 1 wherein said means for attaching comprises side flaps which depend from said attachment element on opposed sides of the batten.

8. The batten extender of claim 1 wherein said means for attaching comprises nails that extend through said attachment element into the underlying batten.

* * * * *